US005145279A

United States Patent [19]

Larcheron et al.

[11] Patent Number: 5,145,279

[45] Date of Patent: Sep. 8, 1992

[54] PUBLIC WORKS MACHINE USABLE MORE PARTICULARLY FOR LAYING VERTICAL DRAINS

[75] Inventors: Gérard Larcheron, Ferrieres; Yves Legendre, Balloy/Bazoches-les-Bray, France

[73] Assignee: Enterprises Morillon Corvol Courbot S.A., Villeneuve-le-Roi, France

[21] Appl. No.: 566,444

[22] PCT Filed: Dec. 18, 1989

[86] PCT No.: PCT/FR89/00658

§ 371 Date: Aug. 24, 1990

§ 102(e) Date: Aug. 24, 1990

[87] PCT Pub. No.: WO90/07611

PCT Pub. Date: Jul. 12, 1990

[30] Foreign Application Priority Data

Dec. 26, 1988 [FR] France ..... 88 17171

[51] Int. Cl.[5] ..... E02B 11/02; E02D 3/10

[52] U.S. Cl. ..... 405/50; 173/49; 405/232

[58] Field of Search ..... 405/50, 232, 303; 173/22, 49, 81, 125, 134

[56] References Cited

U.S. PATENT DOCUMENTS

| | | | |
|---|---|---|---|
| 2,046,323 | 7/1936 | DeWolfe . | |
| 3,365,004 | 1/1968 | Johansson . | |
| 4,745,979 | 5/1988 | Morimoto | 405/50 X |
| 4,755,080 | 7/1988 | Cortlever et al. | 405/50 |

FOREIGN PATENT DOCUMENTS

| | | |
|---|---|---|
| 2365445 | 3/1975 | Fed. Rep. of Germany . |
| 2600173 | 7/1977 | Fed. Rep. of Germany . |
| 25970 | 10/1912 | United Kingdom . |
| 2171738 | 9/1986 | United Kingdom . |

*Primary Examiner*—David H. Corbin
*Attorney, Agent, or Firm*—Roland Plottel

[57] ABSTRACT

A public works machine is disclosed usable particularly for laying vertical artificial drains, of the type comprising a carrier frame, a tool carrying mobile assembly and means fast with the frame for vertically guiding the mobile assembly, characterized in that said mobile assembly (28) comprises a plurality of penetrating tools (34, 134, 234, 334) in particular for simultaneously laying several drains, and in that said guide means comprise a plurality of guide paths with vertical extension (38, 138, 238, 338). Advantageously, the guide paths are formed by suitably stretched cables.

15 Claims, 3 Drawing Sheets

PUBLIC WORKS MACHINE USABLE MORE PARTICULARLY FOR LAYING VERTICAL DRAINS

BACKGROUND OF THE INVENTION

The present invention- relates to a public works machine, usable particularly for laying vertical drains, not only on land but also under water.

Generally, vertical draining is carried out so as to improve the bearing capacity of certain soils, such as compressible soils intended to receive building works foundations.

The invention is particularly well adapted to laying flexible artificial drains such as linered tubes or strips, covered or not with a textile filter and disposed in a pre-established mesh of approximately several meters to the meter, depending on the draining capacity to be obtained.

PRIOR ART

Among the current drain laying methods, a method is used in which a steel tube surrounding the drain is driven in vertically, the foot of the steel tube being equipped with an expendable shoe fixed to the drain. This driving in operation is performed by a mobile machine movable along a path corresponding to the chosen mesh.

SUMMARY OF THE INVENTION

With the increase of drainage depths (up to 30 to 40 meters), the lengths of drains to be laid on the site nowadays reach several hundred kilometers. The invention proposes a high yield laying machine for reducing the on-site times. The invention provides then a public works machine, usable more particularly for laying vertical artificial drains, of the type comprising a carrier frame, a tool carrying mobile assembly and means fast with the frame for guiding the mobile assembly vertically, characterized in that the mobile assembly comprises a plurality of penetrating tools, particularly for simultaneously laying several drains, and in that said guide means comprise a plurality of guide paths with vertical extension disposed for at least two of them with spacing therebetween.

Thus, with the invention, it is possible to increase the number of drains laid during the same operation, while respecting correct horizontal and vertical positioning of the drains through appropriate guiding.

Advantageously, the guide paths and the penetrating tools are disposed symmetrically with respect to the same vertical axis called guide axis. This arrangement eliminates the cantilever met with in particular in installations equipped with a single guide mast in a lateral position (the weight of the mobile assembly possibly reaching several tons) and, consequently, makes possible the use of a lighter guide structure easier to position on the worksite.

In an advantageous embodiment of the invention, the guide paths are formed by cables, or thin suitably stretched profiles. In a particular variant, the cables are stretched between two spacing structures fixed to the carrier frame. In particular, the frame comprises a platform carrying a pivoting lifting jib, the spacing structures being respectively fixed to the free end of the jib and to the end of a projection of the platform. The use of cables or thin profiles as guide paths facilitates the adjustment and the height and spacing dimensioning of the guide means as a function of the mobile assembly and of the height and spacing of the drains to be laid.

In variants of the invention, guiding of the penetrating tools may be further improved in several ways, particularly by spacing the guide paths apart by a distance close to the elementary spacing provided for the drains and/or by mounting the penetrating tools on a set of cross-pieces themselves mounted for sliding on the guide means.

In another embodiment of the invention, the mobile assembly comprises a driving head, for example a hydraulic vibrator, mounted for sliding on the guide paths and associated with a force transmitter-distributor coupled to the penetrating tools.

BRIEF DESCRIPTION OF THE DRAWINGS

The invention will now be described with reference to the accompanying drawings in which.

DESCRIPTION OF THE PREFERRED EMBODIMENTS

Figure 1:
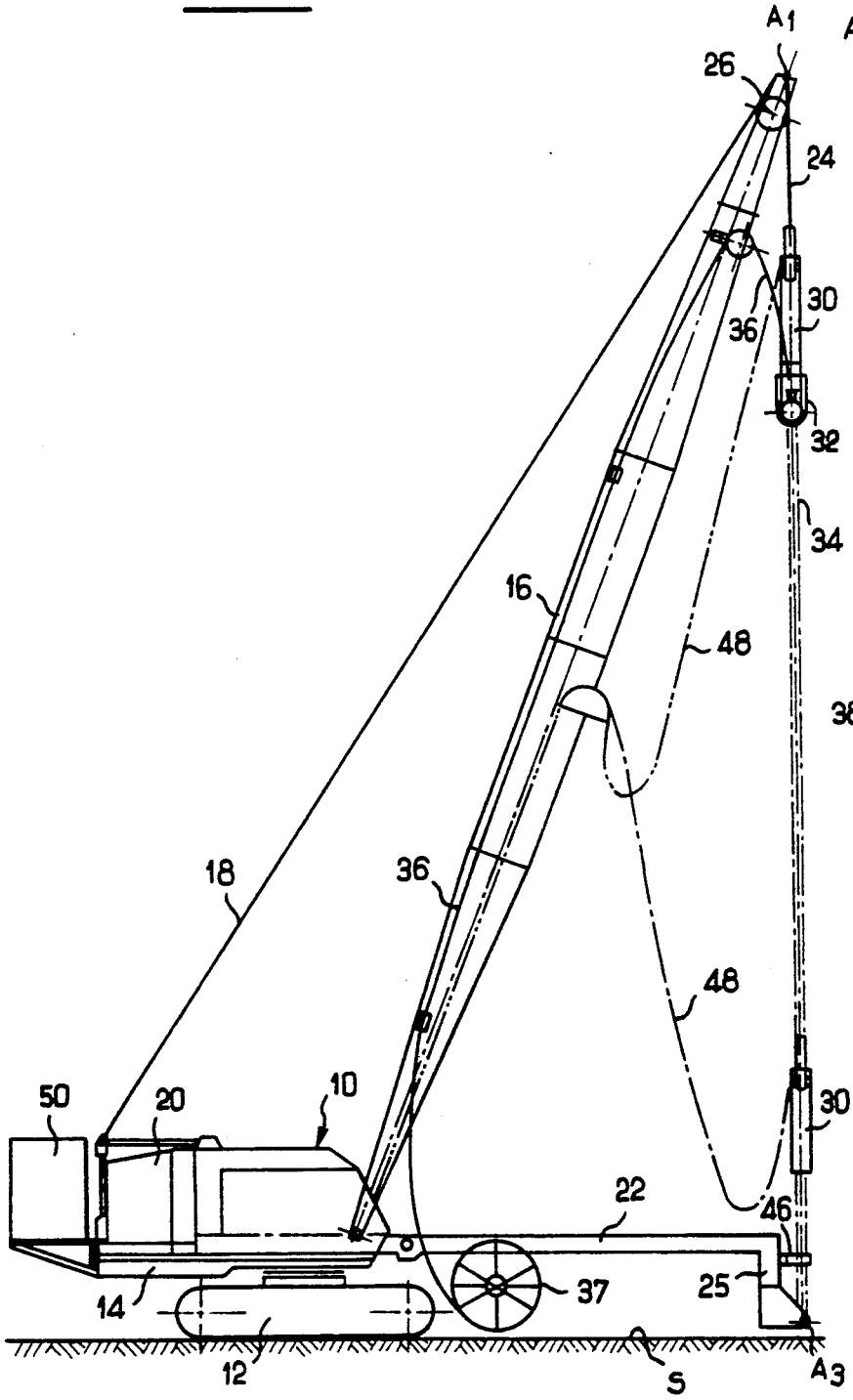
FIG. 1 shows a schematic side view of one embodiment of a vertical drain laying machine in accordance with the invention, FIGS. *2a* and *2b* are partial schematic front views similar to FIG. 2, showing a rotating drive assembly and a hydraulic drive assembly respectively.

Referring to FIG. 1, the vertical drain laying machine has a motor driven carrier frame 10 mounted for rotation on a tracked chassis 12. The frame comprises a platform 14 on which a lifting jib 16 is mounted for pivoting in a conventional way, and held in position by an assembly formed by cables 18 and a winch (not shown) driven by the main motor 20 of the machine. At the front of platform 14 is provided a projection 22 (of a length adjustable by a telescopic device and mounted for pivoting so as to be folded back during transport of the machine outside the worksite) which ends in a spacer strut 25 extending close to the ground S.

Figure 2:
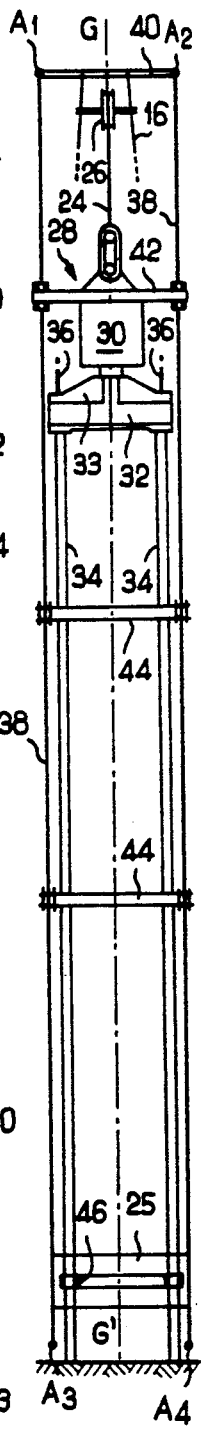
FIG. 2 shows a partial schematic front view of the machine illustrated in FIG. 1, FIG. 3, a partial front view of a tool carrying mobile assembly according to another embodiment of the invention.

Jib 16 comprises a conventional lifting assembly with a carrier cable 24 mounted on a pulley 26 disposed at the head of the jib and from which a mobile tool carrying assembly 28 is suspended (illustrated in greater detail in FIG. 2). This mobile assembly 28 is formed, by way of non limitative example, of a driving head 30 fast with a force transmitter-distributor 32 associated with several penetrating tools 34 (in the present case two tools mounted in parallel symmetrically with respect to the driving head 30), such as steel tubes adapted for penetrating into the ground and each receiving a flexible drain 36. Drains 36 are reeled off as required from two drums 37 disposed on each side of projection 22 and are conveyed towards tubes 34 by jib 16.

The mobile assembly 28 is guided by guide means fixed to the carrier frame 10 and comprising a plurality (two in the example described here) of vertically extending guide paths 38. These two guide paths are spaced apart from each other. The spacing, which is readily adjustable, is chosen so as to maintain the mobile assembly and the penetrating tools in a pre-established position. Such spacing is chosen depending on the number of guide paths and may be variable for each pair of guide paths.

In a particularly advantageous embodiment, the guide paths are formed by cables 38 whose ends are fixed to strut 25 and to another spacing structure (here strut 40) fixed to the head of jib 16. Cables 38, of adjustable length, are stretched by turnbuckles (not shown). Their vertical extension is considerable and may reach several tens of meters. Without departing from the scope of the invention, other variants (not shown) of the thin profiles can be used such as bars, rods, shaped sections instead of the cables. As shown in FIG. 2, the driving head 30 is fast with a cross-piece 42 mounted for sliding on the two cables 38.

In a very interesting arrangement of the embodiment described here, the spatial arrangement of the guide paths 38, with respect to the lifting cable 24 and the penetrating tools (tubes 34) is such that the guide cables 38 and the driving tubes 34 are disposed symmetrically with respect to the same vertical axis G—G' called guide axis. For this, the struts 25 and 40 are centered with respect to the guide axis G—G', in this case with respect to the axis of symmetry of the mobile assembly (here represented by cable 24) and the four anchorage points of the guide cables A1, A2, A3 and A4 are disposed in a vertical plane passing through the lifting cable 24 in line with the output of the groove of pulley 26. This arrangement in particular avoids the cantilever effects which might be considerable considering the weight of the mobile assembly (between one and two tons).

The guide means also comprise a set of cross-pieces 44 on which tubes 34 slide and which are themselves mounted for sliding on the guide cables 38. These cross-pieces participate in holding tubes 34 in position so as to avoid the risk of buckling of the latter during the laying of deep drains. The cross-pieces 44 coupled by holding chains (not shown) to the force transmitter-distributor 32 are stacked gradually on strut 25 as tubes 34 are lowered into the ground. This strut 25 also comprises two positioning collars 46 for the tubes close to ground S.

Furthermore, it can be seen in FIG. 2 that the guide paths are advantageously disposed at the side of the penetrating tools spaced apart, in this case by way of non limitative example, by a distance close to the elementary spacing provided for the drains. In the particular arrangement illustrated in FIG. 2, the cables are disposed outside tubes 34, with respect to the axis G—G'.

Thus, with the invention, it is possible to lay several (two) drains simultaneously while controlling the horizontal and vertical positioning of each (which is important for the drainage quality) with a light structure, (without penalty of weight with respect to a single drain machine with guide mast) with easy dimension adjustment and positioning.

So as not to overload FIG. 1, only the driving head 30 has been shown in the top and bottom position. In the embodiment described here, driving head 30 is of the hydraulic vibrator type fed with a high pressure fluid by flexible pipes 48 from a hydraulic unit 50 carried by platform 14. Vibrator 30 is of conventional architecture and comprises a battery of excentrics driven in rotation by the pressurized fluid so as to transmit vertical oscillating vibrations (via an attachment gripper here associated with distributor 30) to the penetrating tools in this case to tubes 34. These vibrations, of a frequency between 1500 and 2500 vibrations/minute, are transmitted to the ground. In the immediate vicinity of the penetrating tube there occurs fluidification of the ground which facilitates the penetration (or removal) of the tube. The force transmitter-distributor 32 is in the form of a U shaped beam whose ends receive the two heads for fixing tubes 34. As shown in FIG. 2, the sides of the U shaped piece are formed by reinforced plates in the form of an isosceles triangle receiving at their apices the attachment gripper of vibrator 30. Of course, all the mobile assembly is centered on the guide axis G—G'.

Figure 2A:
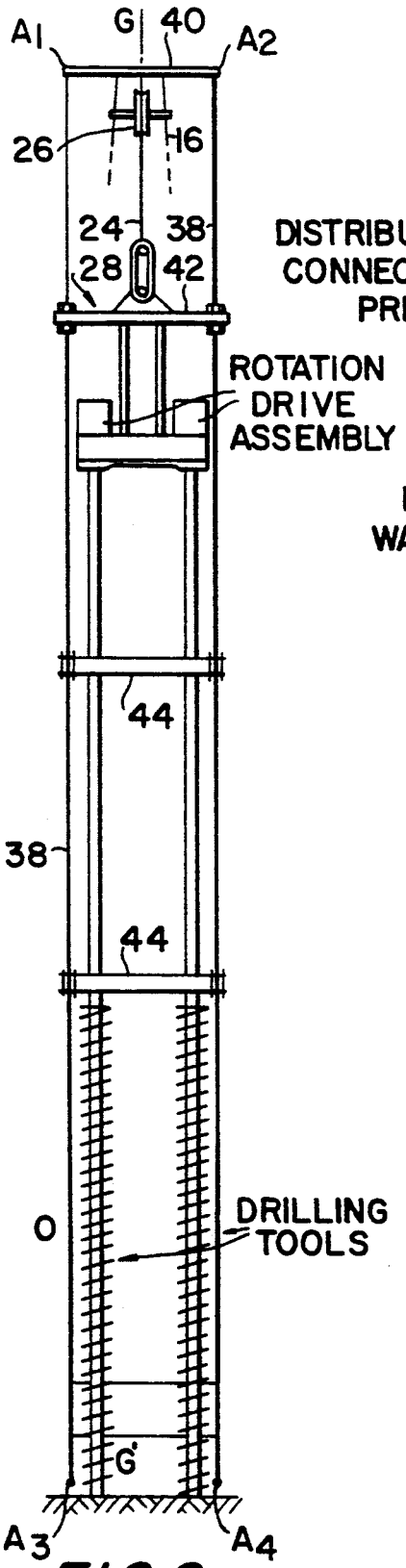
Figure 2B:
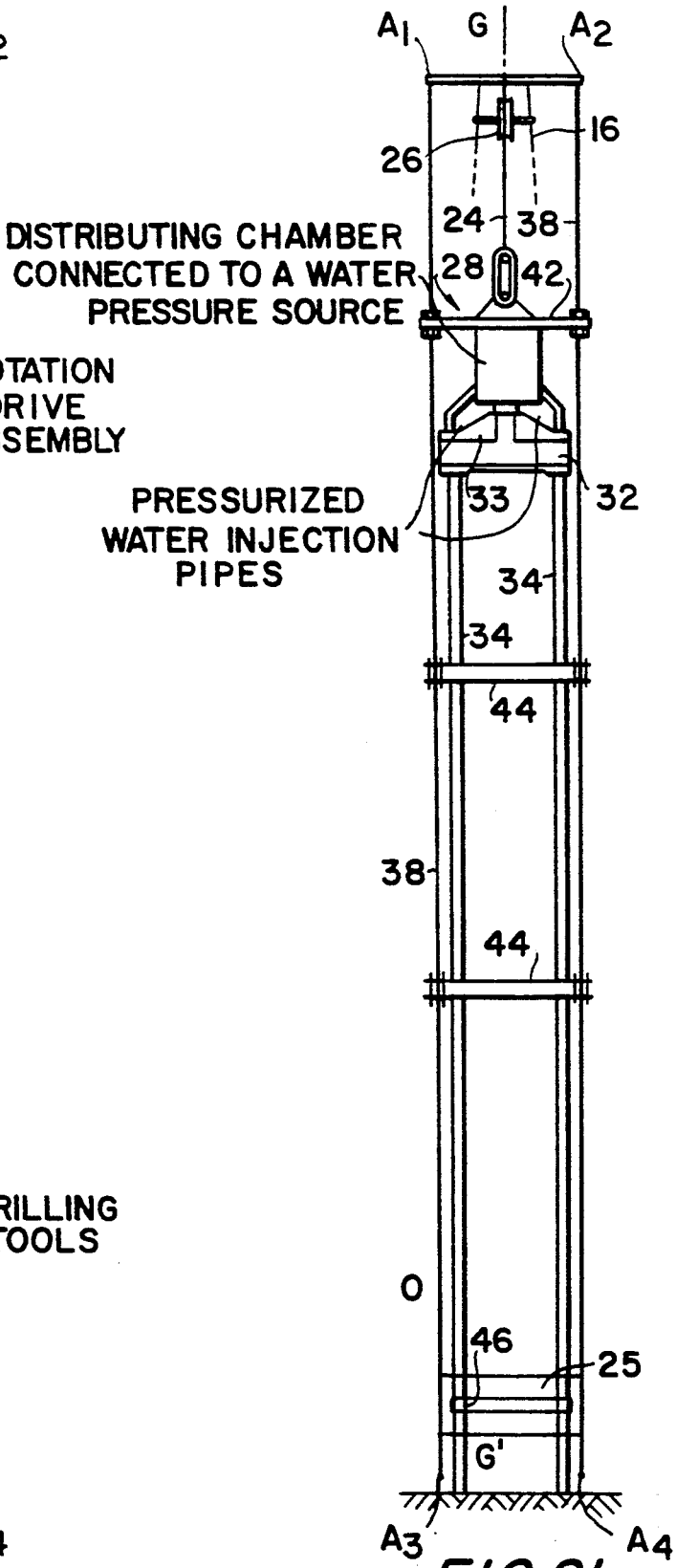

The machine thus described is used in the following way. After the machine has been placed in the work position with respect to the ground, the tubes, in the raised position, are equipped with drains and foot shoes. Then the two tubes are driven in simultaneously by vibro-driving until the required depth is reached. Tubes 34 are then raised by pulling, the drains remaining in position because of the shoes which catch in the ground. Finally, the drains thus laid may be cut so as to move the machine to its new working position. Without departing from the scope of the invention, other embodiments propose other types of driving heads for example with percussion or hydraulic hammer as shown in FIGS. 2*a* and 2*b*, or even mobile assemblies with jetting head, or drilling head.

Figure 3:
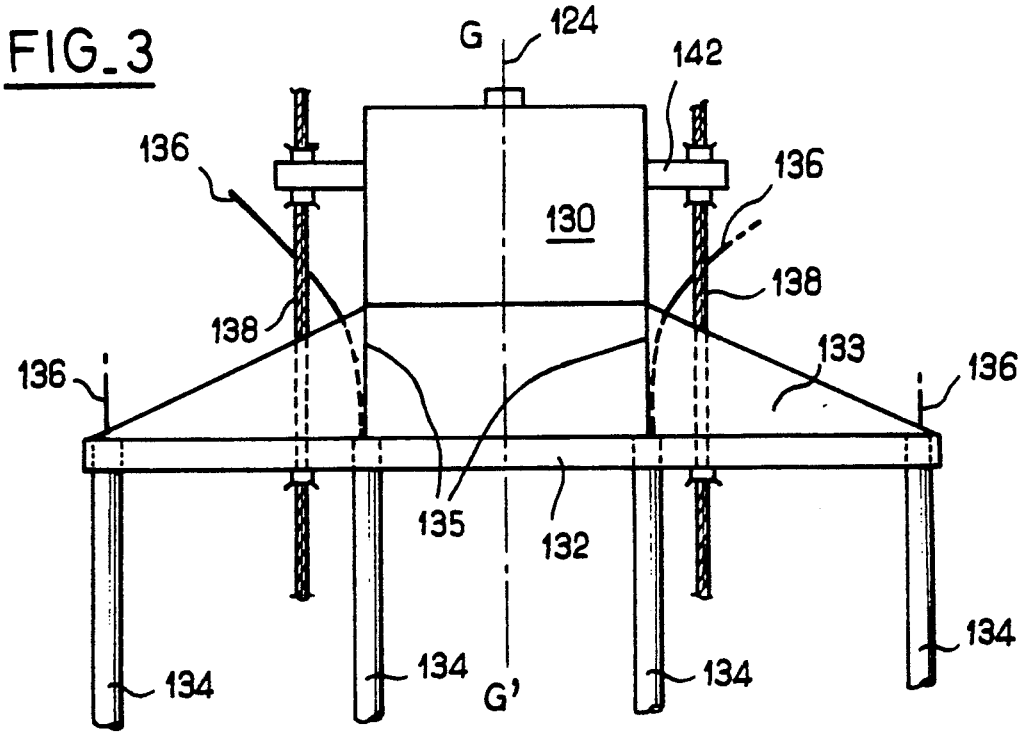
Figure 4:
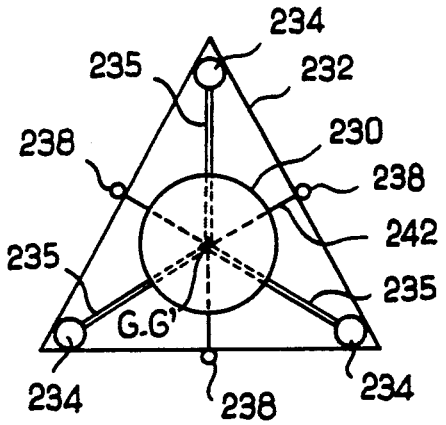
FIGS. 4 and 5 show schematic top views of two mobile assemblies, respectively for three or four drains, according to two other embodiments of the invention.
Figure 5:
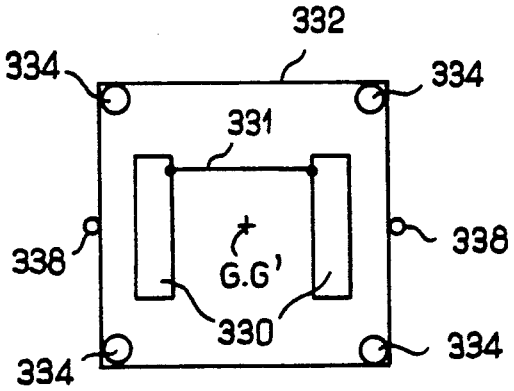

FIGS. 3, 4 and 5 show schematically and partially three other embodiments of tool carrying mobile assemblies in accordance with the invention; the elements which are identical or similar to those described above in connection with FIGS. 1 and 2 bear the same numeric references increased respectively by 100, 200 and 300.

The mobile assembly illustrated in FIG. 3 makes possible the simultaneous laying of four drains 136 guided by the four penetrating tubes 134 fixed to the horizontal portion of the force distributor 132 in an arrangement of two internal tubes and two external tubes symmetrical with respect to the guide axis G—G', such as illustrated in FIG. 3. In the present case, cables 138 are disposed in the vicinity, but outside with respect to axis G—G', of the internal tubes 134. On the guide cables 138 are slidingly mounted the driving head 30 via the strut 142 and the horizontal portion of the distributor 132.

To improve the distribution of the oscillating vibratory forces, the triangular plates 133 are provided with reinforcements 135 disposed starwise from the tip of the plates towards the engagement heads of the tubes, such as illustrated in FIG. 3. Although not shown in FIG. 3, a set of cross-pieces is provided (corresponding to cross-pieces 44), mounted for sliding on cables 138 so as to contribute to guiding of the four tubes 134.

FIGS. 4 and 5 illustrate two other embodiments of the force transmitter-distributor according to the invention. Generally, the force transmitter-distributor comprises a flat structure (frame or plate) 232, 332, defining a regular polygon centered on the vertical guide axis G—G'. The penetrating tools, here tubes 234 and 334, are fast with the flat structure in a symmetrical arrangement with respect to the axis G—G', preferably at the apices of the regular polygon defined on the structure. Finally, structure 232, 332 is mounted for sliding on the guide cables in an arrangement also symmetrical with respect to axis G—G'. The force transmitter-distributor illustrated in FIG. 4 makes it possible to lay simultaneously three drains disposed in a triangular mesh. As illustrated schematically in the figure, the flat structure 232, in the form of an equilateral triangle, receives tubes 234 at its apices and is mounted for sliding, preferably by the middles of its sides, on the three guide cables 238 themselves disposed at the apices of an equilateral triangle. In the present case, the spacing between cables is about half that of the drains to be laid. Of course, the spacing structures (corresponding to structures 40 and 24) are adapted to this triangular arrangement of the cables. The driving head is, in the example described here, a hydraulic hammer of cylindrical shape 230 held centered on axis G—G' by three lugs 242 mounted for sliding on cables 238. The flat structure 232 is provided with vertical ribs 235 disposed as illustrated in FIG. 4 so as to distribute evenly the force transmitted by the driving head 230.

The force transmitter-distributor illustrated in FIG. 5 makes possible the simultaneous laying of four drains disposed in a square mesh. As illustrated schematically in FIG. 5, the flat structure 332 is in the form of a square plate to the apices of which are fixed the four penetrating tubes 334, the whole being centered on the axis G—G'. The square plate is further mounted for sliding on two guide cables 338, by the middles of two opposite sides. In the embodiment described here, the driving head is formed of two hydraulic vibrators 330 mounted in parallel and symmetrically with respect to axis G—G' and suitably coupled to a synchronism bar 231. In a variant not shown of this embodiment of the invention, each cable 338 is replaced by a pair of cables mounted close to each other symmetrically with respect to the middle of one of two opposite sides of the square plate. It should however be noted that in this four cable arrangement, at least some of the cables are spaced apart from each other (by choosing two cables each taken from a different pair).

The invention can also be used on water without particular difficulty. In one embodiment (not shown) of the invention, platform 14 is mounted on a floating barge.

The invention is not limited to the laying of vertical drains but may be used for other applications in which a plurality of tools are driven vertically into the ground simultaneously.

We claim:

1. Public works machine usable particularly for laying vertical artificial drains, said machine comprising a carrier frame including a platform (14) carrying a pivoting lifting jib (16) provided with a free end, a tool-carrying mobile-assembly (28) comprising a plurality of separate penetrating tools (34, 134, 234, 334) in particular for simultaneously laying several separate drains spaced by an elementary drain spacing, and guide means for vertically guiding the mobile assembly, said guide means comprising two spacing structures, a top spacing structure (42) fixed to the free end of the jib and a bottom spacing structure (25) fixed to a projection end of the platform, and a plurality of guide paths with vertical extension (38, 138, 238, 338) disposed for at least two of said guide paths with a spacing therebetween at least equal to the half of the elementary drain spacing, said guide paths being formed with cables or thin profiles, particularly rods, suitably stretched between the said spacing structures (25, 42).

2. Machine according to claim 1, characterized in that said guide paths (38, 138, 238, 338) and said penetrating tools (34, 134, 234, 334) are disposed symmetrically with respect to a common vertical axis called guide axis G—G'.

3. Machine according to claim 1, characterized in that said guide paths (38, 138) are spaced apart from each other by a distance close to the elementary drain spacing.

4. Machine according to claim 1, characterized in that said penetrating tools (34) are mounted for sliding on a set of cross-pieces (44) themselves mounted for sliding on said guide paths.

5. Machine according to claim 1 characterized in that said mobile assembly is of the jetting head type.

6. Machine according to claim 1, characterized in that said mobile assembly is of the drilling head type.

7. Machine according to claim 1, characterized in that the mobile assembly (28) comprises a driving head (30, 130, 230, 330) mounted for sliding on the guide paths (38, 138, 238, 338) and associated with a force transmitter-distributor (32, 132, 232, 332) coupled to the penetrating tools (34, 134, 234, 334).

8. Machine according to claim 7, characterized in that the force transmitter-distributor (32, 132) comprises a beam to which said penetrating tools (34, 134) are fixed in a symmetrical arrangement with respect to the driving head (30, 130).

9. Machine according to claim 7, characterized in that the force transmitter-distributor (232, 332) comprises a flat structure (frame or plate) mounted for sliding on the guide paths and defining a regular polygon, said penetrating tools (234, 334) being fixed to the flat structure in a regular polygonal distribution preferably at the apices of said polygon.

10. Machine according to claim 9, characterized in that said flat structure (332) is in the form of a square whose two opposite sides are mounted for sliding, preferably at the middle thereof, on said guide paths (338).

11. Machine according to claim 9, characterized in that said flat structure (232) is in the form of an equilateral triangle whose three sides are mounted for sliding, preferably in the middle thereof, on said guide paths (238).

12. Machine according to claim 1, characterized in that said driving head is of the hydraulic vibratory type.

13. Machine according to claim 1, characterized in that said driving head is of the percussion hammer type.

14. Machine according to claim 1 including means for rendering said machine.

15. Machine according to claim 7 characterized in that said driving head is of the hydraulic hammer type.

* * * * *